United States Patent [19]

Gardner

[11] Patent Number: 4,905,350

[45] Date of Patent: Mar. 6, 1990

[54] PLIER-TYPE CLAM OPENER

[76] Inventor: Irving Gardner, P.O. Box 294, Hunter, N.Y. 12442

[21] Appl. No.: 356,240

[22] Filed: May 24, 1989

[51] Int. Cl.[4] ..... A22C 9/00

[52] U.S. Cl. ..... 17/75; 17/48; 30/120.4; 81/314

[58] Field of Search ..... 17/75, 74, 48; 30/120.1, 120.2, 120.3, 120.4, 120.5; 81/314, 416

[56] References Cited

U.S. PATENT DOCUMENTS

| | | | |
|---|---|---|---|
| D. 196,381 | 9/1963 | Basilotta | 17/75 |
| 708,014 | 9/1902 | Blagden | 17/75 |
| 837,465 | 12/1906 | Gorman | 17/75 |
| 1,212,464 | 1/1917 | Edwards | 17/75 |
| 1,597,622 | 8/1926 | Richens | 17/75 |
| 1,987,399 | 1/1935 | Harris | 30/120.5 |
| 2,473,608 | 6/1949 | Plock | 17/75 |
| 2,490,615 | 12/1949 | Bloomfield | 30/120.4 |
| 2,720,900 | 10/1955 | Quist | 30/120.4 |
| 3,253,487 | 5/1966 | Bentley, Jr. | 81/314 |
| 3,685,097 | 8/1972 | Scott et al. | 17/75 |
| 3,706,114 | 12/1972 | Waechter | 17/75 |
| 4,062,218 | 12/1977 | Wiener | 81/314 |
| 4,255,835 | 3/1981 | Demulder | 17/74 |

FOREIGN PATENT DOCUMENTS

| | | | |
|---|---|---|---|
| 896819 | 4/1972 | Canada | 17/75 |
| 253768 | 11/1912 | Fed. Rep. of Germany | 30/120.5 |

OTHER PUBLICATIONS

Popular Science, Jun. 1989, Vice Squad by Phil McCafferty, pp. 134–136.

*Primary Examiner*—Willis Little
*Attorney, Agent, or Firm*—Charles J. Brown

[57] ABSTRACT

A tool, particularly a hand tool for opening clams, in which opposed jaw elements are incrementally pivoted closer together by successive opening and closing of handle elements, one fixed to one jaw element and the other pivoted to the other jaw element, with a toggle arm between the handle elements acting as a pawl to advance along ratchet teeth on one of the handle elements.

13 Claims, 2 Drawing Sheets

PLIER-TYPE CLAM OPENER

BACKGROUND OF THE INVENTION

Various devices have long been available for opening clams and oysters. In most cases a given device is suitable for opening either of the shellfish, which is true of the present invention as well, and hence when clams are referred to herein it is to be understood that oysters and other bivalves are to be included.

One category of prior art openers utilizes an opening arm hinged to a fixed base, from the simple device of U.S. Pat. No. 1,597,622 to the more involved designs of U.S. Pat. Nos. 837,465, 1,212,464 and 4,255,835. The latter all include some form of pawl and ratchet to advance the opener knife or point incrementally into the clam in a linear, not angular, fashion by complicated mechanisms unsuitable for handheld plier-type devices.

The other catetory of prior art openers consists of simpler plier-type tools squeezed by hand to close jaws about a clam and wedge its half shells apart. The opener of the invention is generally in that category though as will be seen it could be adapted to a fixed base. U.S. Pat. Nos. 2,473,608 and 3,706,114 disclose scissors-style openers having one or more fixed pivot points. The opener of U.S. Pat. No. 3,685,097 incorporates an adjustable pivot point to accomodate clams of different sizes and to achieve variable mechanical advantage. In none of these plier-type prior art openers is a pawl and ratchet employed to close the jaws incrementally about the clam.

The present invention applies the pawl and ratchet principle to a hand-squeezed plier-type opening tool to permit clams of various sizes to be opened by successive squeezings with maximal mechanical advantage and therefore requiring minimal physical effort. In addition, and of equal importance, is the matter of safety. Since the tool of the invention closes in increments it is impossible accidentally to slip off the clam and injure the fingers of the operator.

STATEMENT OF THE INVENTION

The tool of the invention comprises first and second opposed jaw elements pivoted together at one end to open and close with a work piece therebetween. A first handle element extends rigidly from the first jaw element and a second handle element opposed to the first handle element extends from and is pivoted to the second jaw element. A toggle arm is pivoted at one end to the second handle element and has an opposite pawl end extending into a longitudinal recess in the first handle element. Ratchet teeth are provided on the first handle element longitudinally disposed in the recess and engageable with the pawl end of the arm therein. Biasing means urge the handle elements apart and the pawl end of the arm against the ratchet teeth. As the handle elements are successively brought together and apart the pawl end of the arm advances along the ratchet teeth toward the jaw elements and the second jaw element is thus incrementally pivoted progressively closer the the first jaw element.

In a preferred form of the invention the tool is hand operated and is intended for opening clams. Thus a seat element is pivoted to the first jaw element for receiving the hinged end of a clam, and is foldable in over the first jaw element for smaller clams or out from the end of the first jaw element for larger clams. A wedge element is preferably fixed to the second jaw element and is opposed to the seat element for entering between and opening the half shells of the clam.

A wave washer or the like is also preferably incorporated between the handle elements to function as clutch means for retarding the relative angular movement therebetween.

Pin means may be provided on the pawl end of the arm permitting the pawl end to slide in either direction along but not to be removed from the recess.

DESCRIPTION OF PREFERRED EMBODIMENT

Figure 1:
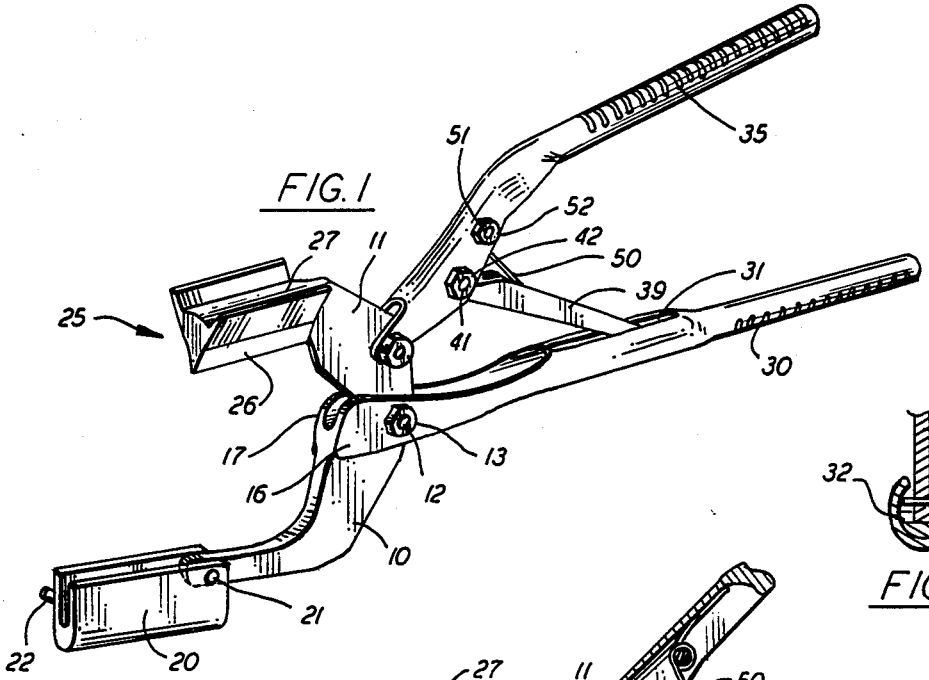
FIG. 1 is a pictorial view of the plier-type clam opener of the invention showing the jaws in open position.
Figure 4:
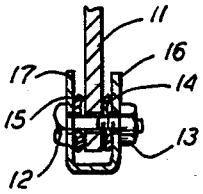
FIG. 4 is a section taken along the line 4—4 of FIG. 2.
Figure 2:
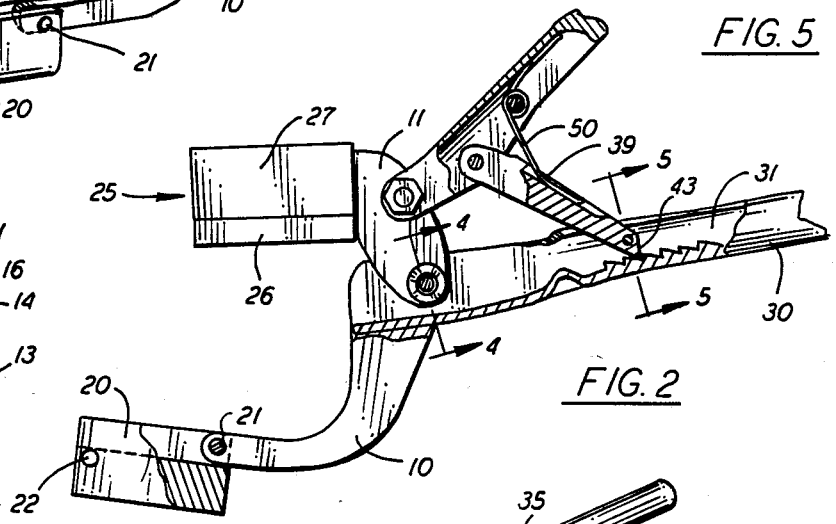
FIG. 2 is an enlarged fragmentary elevation partly in section of the clam opener of the invention.
Figure 3:
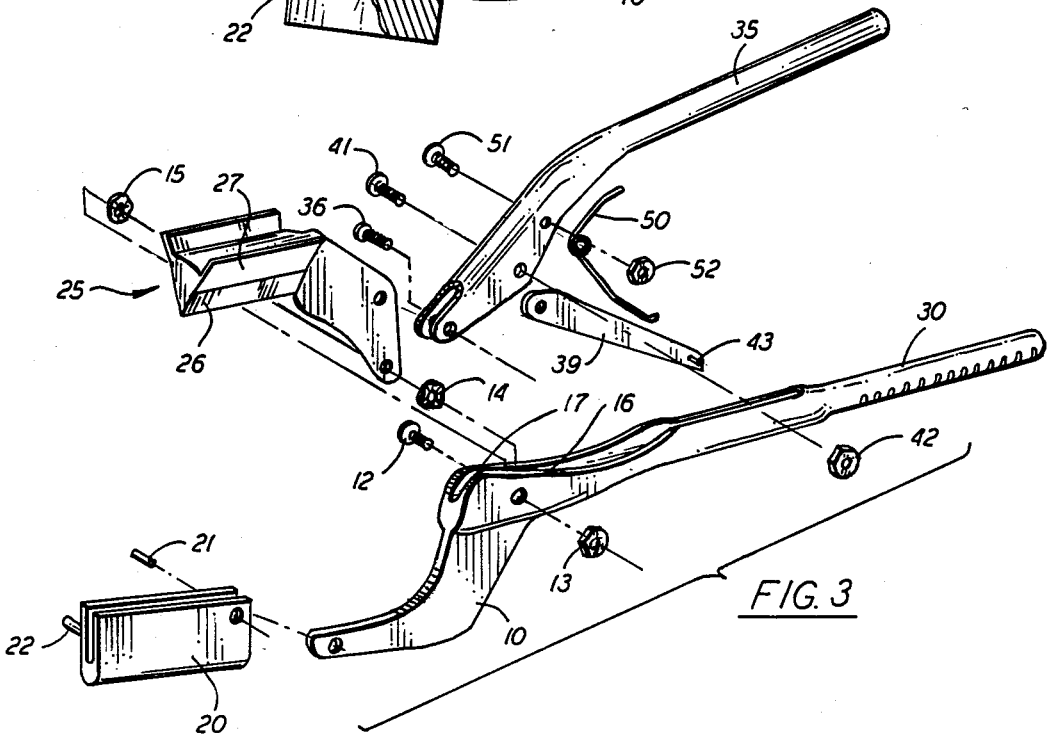
FIG. 3 is an exploded view of the clam opener of the invention.

Referring first to FIGS. 1 to 3 the plier-type clam opener of the invention includes a first jaw element 10 and a second jaw element 11, both of generally curved configuration with their concave edges in opposition to one another. They are pivoted together by means of a pivot screw 12 to which a nut 13 is threaded. As shown particularly in FIG. 4, wave washers 14 and 15 are fitted between the second jaw element 11 and channel sidewalls 16 and 17 on the first jaw element 10 to function as clutch means for retarding relative angular movement between the jaw element 10 and the jaw element 11.

Figure 6:
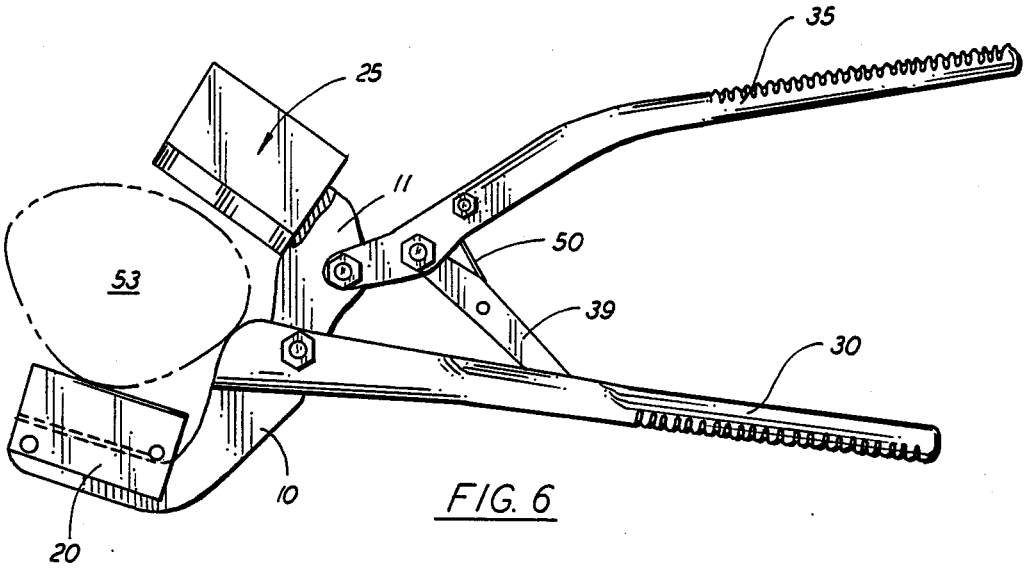
FIG. 6 is a elevation of the opener of the invention with the jaws apart and in position to begin the opening of a clam.
Figure 8:
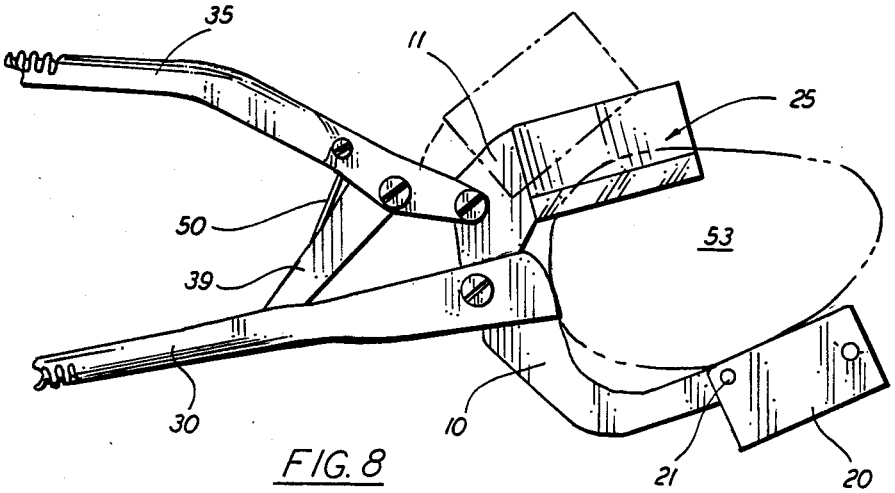
FIG. 8 is an elevation of the opener of the invention with the seat element folded out for receiving a relatively large clam.

A seat element 20 of U-shape is pivoted by a pin 21 to the outer end of the first jaw element 10. It is intended to receive the hinged end of the clam as described hereinafter. The seat element 20 is foldable in so that its slot fits over the first jaw element 10 for smaller clams as shown in FIG. 6 or folded out from the end of the first jaw element 10 for larger clams as shown in FIGS. 1, 2 and 8. To move the seat element between those two positions a fixed pin 22 is provided projecting from the side thereof.

On the second jaw element 11 a wedge element 25 is affixed so as to be opposed to the seat element 20 for entering between and opening the half shells of a clam. The wedge element 25 includes a somewhat sharp knife edge 26 having a cross section of a particularly acute angle for initial entry between the half shells of the clam. It also includes a more obtuse wedge section 27 which forces the half shells apart. It is desirable for the knife edge 26 to be straight so that it first contacts the curved periphery of the half shells along a very limited distance and thereby exerts maximum pressure at that point of contact. For opening shellfish other than clams a different element on the second jaw element 11 may be preferable, as for example a point-type element for opening oysters as shown in U.S. Pat. No. 1,212,464. Such elements may be removable from the second jaw element 11 so as to be replaceable with the particular form selected.

Figure 5:
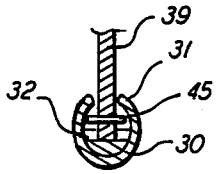
FIG. 5 is a section taken along the line 5—5 of FIG. 2.

A first handle element 30 extends rigidly from the channeled sidewalk 16 and 17 of the first jaw element 10. As shown in FIGS. 2 and 5 the first handle element 30 is partially hollow and defines a longitudinal recess 31. Within that recess is a fixed line of ratchet teeth 32.

A second handle element 35 has a channelled end portion similar to that of the first handle element 30 where it is pivoted to the second jaw element 11 by a pivot screw 36 to which is threaded a nut 37. The second handle element 35 is curved to be generally opposed to the first handle element 30. A toggle arm 39 is pivoted to the second handle element 35 at one end by a pivot screw 41 to which a nut 42 is threaded. The arm 39 has an opposite pawl end 43 which extends into the longitudinal recess 31 in the first handle element 30 and engages the ratchet teeth 32 therein. A cross pin 45 is provided in the pawl end 43 of the arm as shown particularly in FIG. 5 to permit the pawl end to slide in either direction along, but not be removed from, the recess 31. The first handle element 30 is crimped at 47 as shown in FIG. 2 to block movement of the pawl end 43 of the arm 39 and its pin 45 off the ratchet teeth 32 in a direction toward the jaw elements 10 and 11. The pin 45 is sufficiently long so that it cannot pass through the opening of the recess 31, thereby preventing the pawl end 43 of the arm 39 from being removed from the recess 31. However the pawl end 43 of the arm 39 can be lifted upwardly off and out of engagement with the ratchet teeth 32 to allow the pawl end 43 of the arm 39 to slide away from the jaw elements 10 and 11 back to the starting end of the ratchet teeth 32.

A tension spring 50 of resilient wire form is wrapped around a screw 51 to which a nut 52 is threaded and which extends through the second handle element 35. The spring 50 biases the handle elements 30 and 35 apart toward an open position and simultaneously biases the pawl end 43 of the arm 39 against the ratchet teeth 32.

The operation of the tool of the invention is as follows: The second handle element 35 is lifted away from the first handle element 30 so that the pawl end 43 of the arm 39 disengages from the ratchet teeth 32. The second handle element 35 is then pulled rearwardly until the pawl end 43 of the arm 39 abuts the end of the recess 31 remote from the jaw elements 10 and 11. The pawl end 43 then engages the starting end of the line of ratchet teeth 32. This places the tool in its maximum open position as shown in FIGS. 1, 2 and 6.

A clam 53 is placed on the seat element 20, either with the seat element 20 folded in as shown in FIG. 6 for a relatively small clam or folded out as shown in FIG. 8 for a relatively large clam. The wedge element 25 is then brought manually down toward the clam until its knife edge 26 touches the closed half shells of the clam. The handle elements 30 and 35 are not manipulated during this step. After the knife 26 of the wedge 25 is in that position the handle elements 30 and 35 are squeezed together. That portion of the second handle element 35 between the screw 36 and the screw 41 serves as one toggle arm together with the toggle arm 39, and movement of the handle element 35 toward the handle element 30 flattens those two toggle arms to turn the second jaw element 11 a slight increment in a counterclockwise direction as viewed in FIGS. 1 to 3, 6 and 7. To a certain extent this linkage is similar to that of hand tools known as locking pliers, many forms of which are described in the June 1989 issue of *Popular Science* at pages 134 to 136, though locking pliers are designed to cause the toggle to pass over dead center and lock, which is not the case here.

Figure 7:
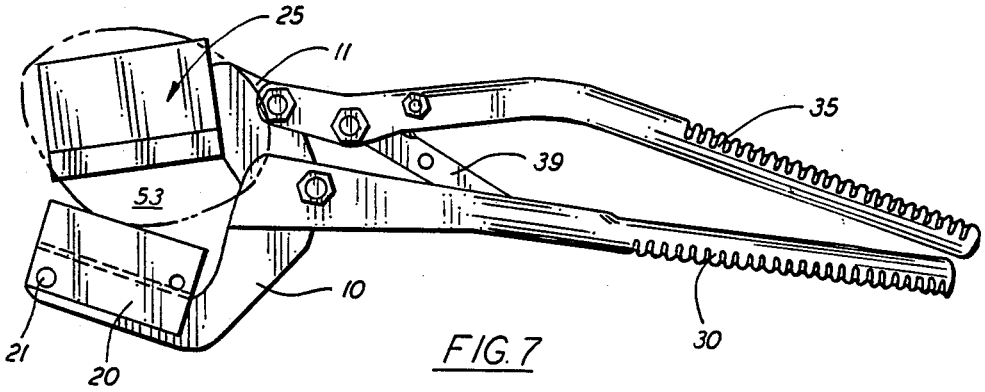
FIG. 7 is a view similar to FIG. 6 illustrating the device as the opening of the clam is being completed.

At the completion of that first incremental turning movement the wave washers 14 and 15 hold the second jaw element 11 in place in relation to the first jaw element 10 as the second handle element 35 is allowed to be biased back to its open position away from the first handle element 30. This moves the pawl end 43 of the arm 39 from the first to the second tooth in the line of ratchet teeth 32. Then when the handle elements 30 and 35 are once more squeezed together the toggle arrangement causes the second jaw element 11 to turn another counterclockwise increment and be held there by the wave washers 14 and 15. This is repeated as the wedge element 25 on the second jaw element 11 is brought progressively closer to the seat element 20 on the first jaw element 10, thereby forcing apart the half shells of the clam 53. In the maximum advanced position of the pawl end 43 of the arm 39, the device appears as shown in FIG. 7 and the clam is fully opened.

It will be apparent that the invention is adaptable to those forms of clam openers which involve a fixed base, in effect by making the first jaw element 10 and its rigidly affixed first handle element 30 part of a base. That and other variations of the invention are to be determined by the following claims rather than by the foregoing description of the preferred embodiment.

I claim:

1. A tool comprising (a) first and second opposed jaw elements pivoted together at one end to open and close with a work piece therebetween, (b) a first handle element extending rigidly from the first jaw element, (c) a second handle element extending from and pivoted to the second jaw element and opposed to the first handle element, (d) a toggle arm pivoted at one end to the second handle element and having an opposite pawl end extending to the first handle element, (e) ratchet teeth longitudinally disposed on the first handle element engageable with the pawl end of the arm, (f) biasing means for urging the pawl end of the arm against the ratchet teeth, (g) whereby as the handle elements are successively brought together and apart the pawl end of the arm advances in engagement along successive ratchet teeth toward the jaw elements and the second jaw element thus is incrementally pivoted progressively closer to the first jaw element, and (h) means for thereafter disengaging the pawl end of the arm from the ratchet teeth by displacement apart of the handle elements as the jaw elements are opened and for returning said pawl end into engagement with the ratchet teeth remote from the jaw elements.

2. A tool according to claim 1 adapted for opening clams which includes a seat element pivoted to the first jaw element for receiving the hinged end of the clam and foldable over the first jaw element for smaller clams or out from the end of the first jaw element for larger clams.

3. A tool according to claim 1 adapted for opening clams and including a wedge element fixed to the second jaw element and opposed seat element for entering between and opening the half shells of the clams.

4. A tool according to claim 1 which includes clutch means in the pivot between the handle elements for retarding relative angular motion therebetween so that they hold their relative position as the pawl end of the arm advances successively from one of the ratchet teeth to the next.

5. A tool according to claim 4 wherein the clutch means is a wave washer.

6. A tool according to claim wherein the biasing means simultaneously biases the handle element apart and the pawl end of the arm against the ratchet teeth.

7. A tool according to claim 1 wherein the biasing means are tension-spring means acting betwen the second handle element and the toggle arm.

8. A tool according to claim 1 wherein the ratchet teeth are located within a longitudinal recess in the first handle element into which the pawl end of the arm extends.

9. A tool according to claim 8 wherein the means for thereafter disengaging the pawl end of the arm from the ratchet teeth includes pin means on the pawl end of the arm permitting the pawl end to slide in either direction along but not to be removed from the recess.

10. A hand tool for opening clams having half shells joined at a hinged end comprising (a) first and second opposed curved jaw elements pivoted together at one end to open and close with a clam therebetween, (b) a seat element pivoted to the first jaw element for receiving the hinged end of the clam and foldable in over the first jaw element for smaller clams or out from the end of the first jaw element for larger clams, (c) a wedge element fixed to the second jaw element and opposed to the seat element for entering between and opening the half shells of the clam, (d) a first handle element extending rigidly from the first jaw element, (e) a second handle element extending from and pivoted to the second jaw element and opposed to the first handle element, (f) wave washers in the pivot between the handle elements functioning as clutch means to retard relative angular movement therebetween, (g) a toggle arm pivoted at one end to the second handle element and having an opposite pawl end extending into a longitudinal recess in the first handle element, (h) ratchet teeth on the first handle element longitudinally disposed in the recess engageable with the pawl end of the arm therein, (i) pin means on the pawl end of the arm permitting the pawl end to slide in either direction along but not be removed from the recess, and (j) tension spring means acting between the second handle element and the toggle arm to bias the handle elements toward an open position and simultaneously to bias the pawl end of the arm against the ratchet teeth, (k) whereby as the handle elements are successively hand-squeezed together and apart the pawl end of the arm advances along the ratchet teeth toward the jaw elements and the wedge element on the second jaw element is thus incrementally pivoted progressively closer to the seat element on the first jaw element to enter between and open the half shells of the clam.

11. A tool according to claim 10 wherein means are provided for disengaging the pawl end of the arm from the ratchet teeth by displacement apart of the handle elements as the jaw elements are opened and for returning said pawl end into engagement with the ratchet teeth remote from the jaw elements.

12. A hand tool for opening clams having half shells jointed by a hinged end comprising (a) first and second opposed jaw elements pivoted together at one end to open and close with a clam therebetween, (b) a seat element pivoted to the first jaw element for receiving the hinged end of the clam and foldable over the first jaw element for smaller clams or out from the end of the first jaw element for larger clams, (c) a first handle element extending rigidly from the first jaw element, (d) a second handle element extending from and pivoted to the second jaw element and opposed to the first handle element, (e) a toggle arm pivoted at one end to the second handle element and having an opposite pawl end extending to the first handle element, (f) ratchet teeth longitudinally disposed on the first handle element engageable with the pawl end of the arm, and (g) biasing means for urging the pawl end of the arm against the ratchet teeth, (h) whereby as the handle elements are successively brought together and apart the pawl end of the arm advances along the ratchet teeth toward the jaw elements and the second jaw element thus is incrementally pivoted progressively closer to the first jaw element.

13. A tool comprising (a) first and second opposed jaw elements pivoted together at one end to open and close with a work piece therebetween, (b) a first handle element extending rigidly from the first jaw element, (c) a second handle element extending from and pivoted to the second jaw element and opposed to the first handle element, (d) a toggle arm pivoted at one end to the second handle element and having an opposite pawl end extending to the first handle element, (e) ratchet teeth longitudinally disposed on the first handle element engageable with the pawl end of the arm and located within a longitudinal recess in the first handle element into which the pawl end of the arm extends, (f) biasing means for urging the pawl end of the arm against the ratchet teeth, and (g) pin means on the pawl end of the arm permitting the pawl end to slide in either direction along but not to be removed from the recess, (h) whereby as the handle elements are successively brought together and apart the pawl end of the arm advances in successive engagement along the ratchet teeth toward the jaw elements and the second jaw element thus is incrementally pivoted progressively closer to the first jaw element.

* * * * *